US006939159B1

(12) United States Patent
Klein et al.

(10) Patent No.: US 6,939,159 B1
(45) Date of Patent: Sep. 6, 2005

(54) ELECTRICAL CONNECTOR WITH CONNECTOR POSITION ASSURANCE AND RIDGE STABILIZED SEAL COVER

(75) Inventors: David Allen Klein, Kernersville, NC (US); Christopher Allgood, Lexington, NC (US); Don Harold Crowe, Bermuda Run, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/807,607

(22) Filed: Mar. 24, 2004

(51) Int. Cl.[7] ..... H01R 13/627

(52) U.S. Cl. ..... 439/352; 439/378

(58) Field of Search ..... 439/352, 350, 439/351, 355, 357, 378

(56) References Cited

U.S. PATENT DOCUMENTS 6,406,319 B2 * 6/2002 Pederson et al. ..... 439/352
2003/0096527 A1 * 5/2003 Greiner ..... 439/352

* cited by examiner

*Primary Examiner*—Renee Luebke

(57) ABSTRACT

An electrical connector includes a housing having a mating end and a wire receiving end. A cover is provided on the wire receiving end of the housing. The cover has a ridge on an interior surface thereof to stabilize the cover on the housing. The cover flexes about the ridge when the cover is mounted on the housing. A connector position assurance element (CPA) is slidably received in a channel on the cover and is movable between a pre-staged position and a staged position. The CPA engages a connector latch on the housing to assure that a mating connector is fully mated to the connector when the CPA is in the staged position. The CPA includes a simply supported latch beam having a latch element thereon that engages a step in the channel to latch the CPA to the cover.

20 Claims, 5 Drawing Sheets

ELECTRICAL CONNECTOR WITH CONNECTOR POSITION ASSURANCE AND RIDGE STABILIZED SEAL COVER

BACKGROUND OF THE INVENTION

The invention relates generally to electrical connectors, and particularly to an electrical connector with a CPA and a stabilized seal cover.

It is known to provide a connector position assurance (CPA) device on electrical connectors to assure that the male and female connectors are fully mated and to prevent unintentional separation of the connectors. The CPA device may be separate from the latching mechanism, or may be integrated as part of the latch.

Typically, the primary function of a CPA device is to indicate that the male and female connectors are fully mated and latched. A secondary function is often to prevent the latching mechanism from inadvertently unlatching, so that the connector halves will not separate. Thus, CPA devices may provide visual and mechanical assurance of the relative positions of the male and female connectors, and thereby verify the complete mating of the male and female connectors.

Typically, the CPA is movable from a first position to a final position only when the connectors are fully mated to the plug housing. The CPA generally includes a deflectable cantilevered beam that is attached to a portion of the CPA. The beam is deflected by projections on the mating connector as the CPA is moved into its final position. The cantilevered beam typically has a latch at the end of the beam distant from a point of attachment to the CPA. When it is desired to increase the latching force of the CPA, such as in some sealed connector applications where a good positive snap action of the CPA is desired, the inherent flexibility of the cantilevered beam may introduce difficulties.

The CPA is typically molded from plastic, and its components must be sufficiently thick to perform their intended function without cracking or breaking, while still being able to flex during assembly. Making the parts larger or heavier or from more expensive materials tend to be unacceptable options from both a cost perspective and a space perspective when it is desired to increase the latching force of the CPA.

BRIEF DESCRIPTION OF THE INVENTION

In an exemplary embodiment of the invention, an electrical connector is provided that includes a housing having a mating end and a wire receiving end. The wire receiving end is configured to receive a terminal contact joined to a wire. A cover is provided on the wire receiving end of the housing. The cover includes a ridge on an interior surface thereof to stabilize the cover on the housing. A connector position assurance element (CPA) is slidably received in a channel on the cover and is movable between a pre-staged position and a staged position. The CPA engages a connector latch on the housing to assure that a mating connector is fully mated to the connector when the CPA is in the staged position.

Optionally, the cover includes a side wall having a recess configured to receive a cover latch on the housing to secure the cover to the wire receiving end of the housing. The cover flexes about the ridge when the cover is mounted on the housing. The CPA includes a latch beam having a latch element thereon that engages a step in the channel to latch the CPA to the cover.

In another embodiment of the invention, an electrical connector is provided that includes a housing having a mating end and a wire receiving end. The wire receiving end is configured to receive a terminal contact joined to a wire. A cover is provided on the wire receiving end of the housing. A connector position assurance element (CPA) is slidably received in a channel on the cover. The CPA includes a platform and a latch beam having a first end oriented toward the mating end and a second end oriented toward the wire receiving end of the housing. The first and second ends are both joined to the platform. The latch beam is configured to engage the channel to latch the CPA to the cover.

DETAILED DESCRIPTION OF THE INVENTION

Figure 1:
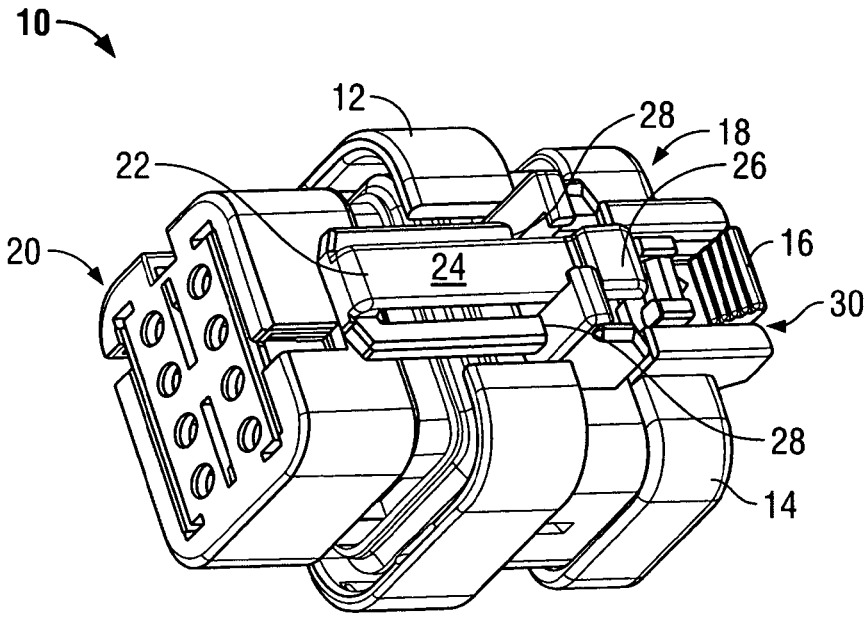
FIG. 1 is a perspective view of a connector plug assembly formed in accordance with an exemplary embodiment of the present invention.

FIG. 1 illustrates a connector plug assembly 10 formed in accordance with the present invention. The connector assembly 10 includes a housing body 12, a seal cover 14, and a CPA 16. The housing body 12 has a wire receiving end 18 through which contacts are loaded into the body 12, and a mating end 20 that joins to a mating connector (not shown). The housing body 12 includes a connector latch 22 that engages a mating connector. The connector latch 22 includes a latch arm 24 and a thumb pad 26. The latch arm 24 and thumb pad 26 are positioned on opposite sides of fulcrum points 28 such that thumb pressure on the thumb pad 26 lifts the latch arm 24 to release the mating connector. The seal cover 14 covers the wire receiving end 18 of the housing body 12. The cover is latched to the housing body 12 as will be described. The CPA 16 slides in a channel 30 on the seal cover 14. The CPA 16 is shown in a pre-staged position.

Figure 2:
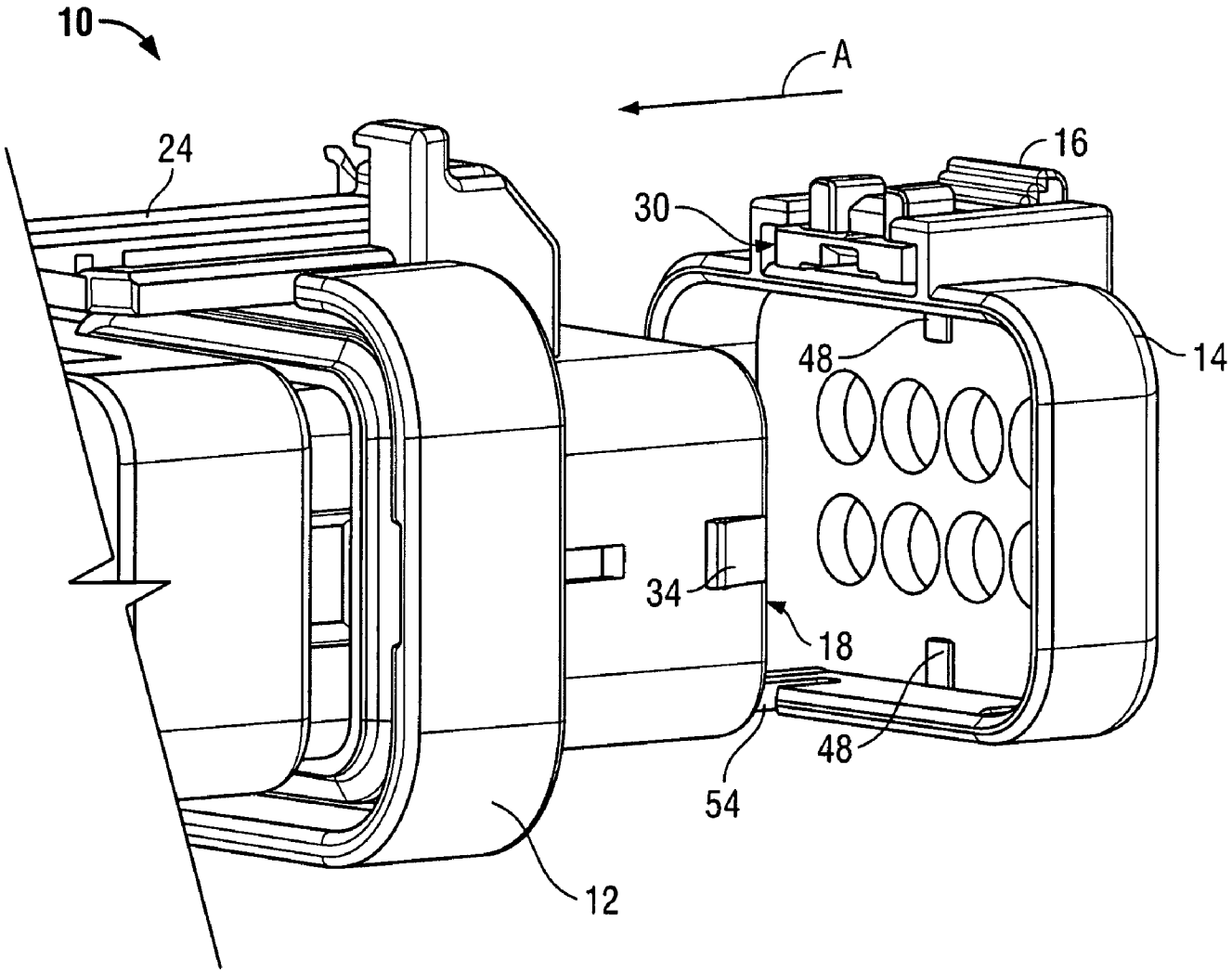
FIG. 2 is a perspective view of the cover and CPA of the connector shown in FIG. 1 separated from the connector.

FIG. 2 illustrates the seal cover 14 and the CPA 16 separated from the housing body 12. A cover latch element 34 is positioned proximate the wire receiving end 18 of the housing body 12. The cover 14 is mounted to the housing body 12 by aligning the cover 14 over the wire receiving end 18 and moving the cover 14 in the direction of arrow A until latched. As the cover 14 is mounted, the cover latch element 34 engages the cover 14 to retain the cover 14 as will be described. When mounted to the housing body 12, the cover 14 is sufficiently stable with respect to the housing body 12 that the CPA 16 can be operated on the cover 14 to assure that a mating connector (not shown) is fully joined to the connector 10.

Figure 3:
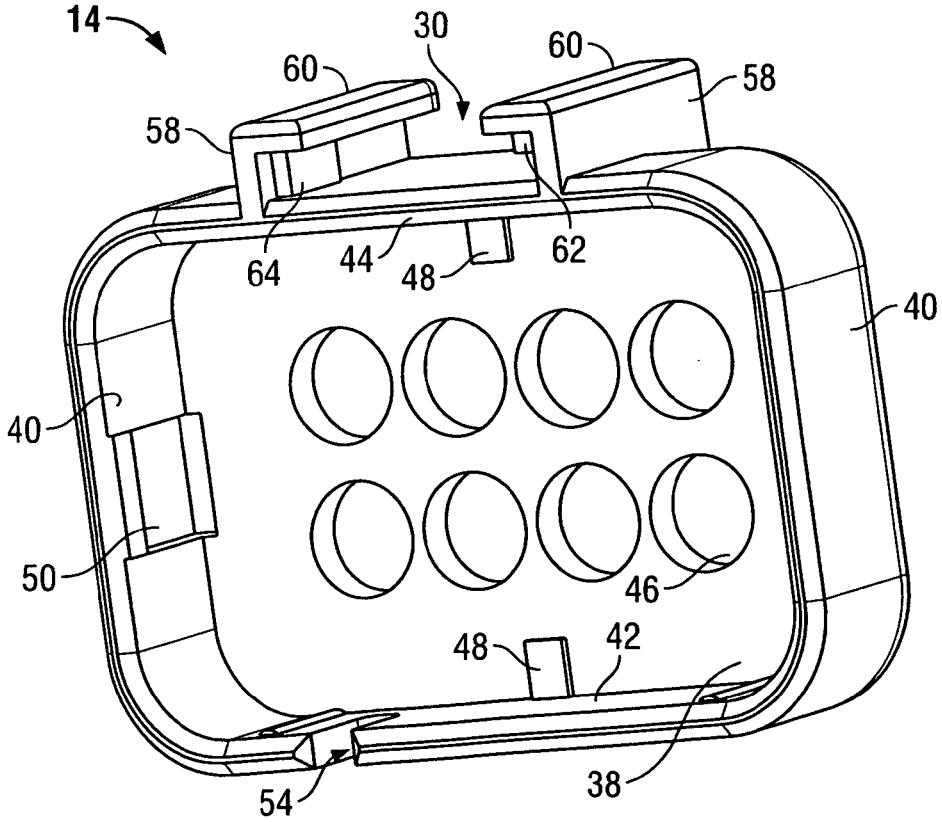
FIG. 3 is a perspective view of the cover shown in FIG. 2.

FIG. 3 illustrates a perspective view of the seal cover 14. The seal cover 14 includes a back wall 38, opposite side walls 40, a bottom wall 42, and a top wall 44. The back wall 38 includes a plurality of contact receiving holes 46 through which contacts (not shown) are loaded into the housing body 12. The back wall 38 also has ridges 48 formed therein that, when the cover 14 is mounted on the housing body 12, engage the wiring receiving end 18 (see FIG. 1). Each side wall 40 includes a recess 50 that receives the cover latch element 34 (see FIG. 2) on the housing body 12 when the cover is mounted to the housing body 12. When the cover 14 is mounted to the housing body 12, the ridges 48 on the back wall 38 interfere with the wire receiving end 18 of the housing body 12 so that the cover 14 flexes about the ridges 48 in order for the cover latch elements 34 to be received in the recesses 50. The interference caused by the ridges 48 stabilizes the seal cover 14 of the housing body 12 when the cover 14 is mounted to the housing body 12.

The bottom wall 42 includes a keying slot 54 that is used to orient the seal cover 14 with the housing body 12. The housing body 12 includes a key (not shown) that is configured to be received within the keying slot 54 to assure that the cover 14 is properly oriented with respect to the housing body 12. The top wall 44 includes the CPA channel 30 on an outer surface thereof. The CPA 16 is slidably received in and operates from within the channel 30. The CPA channel 30 includes side walls 58 and top retaining walls 60. A CPA stop 62 limits the rearward movement of the CPA 16 when the CPA 16 is positioned within the channel 30. Each side wall 58 includes an inward facing step 64 that engages the CPA 16 when the CPA 16 is moved from a pre-staged position to a staged position.

Figure 4:
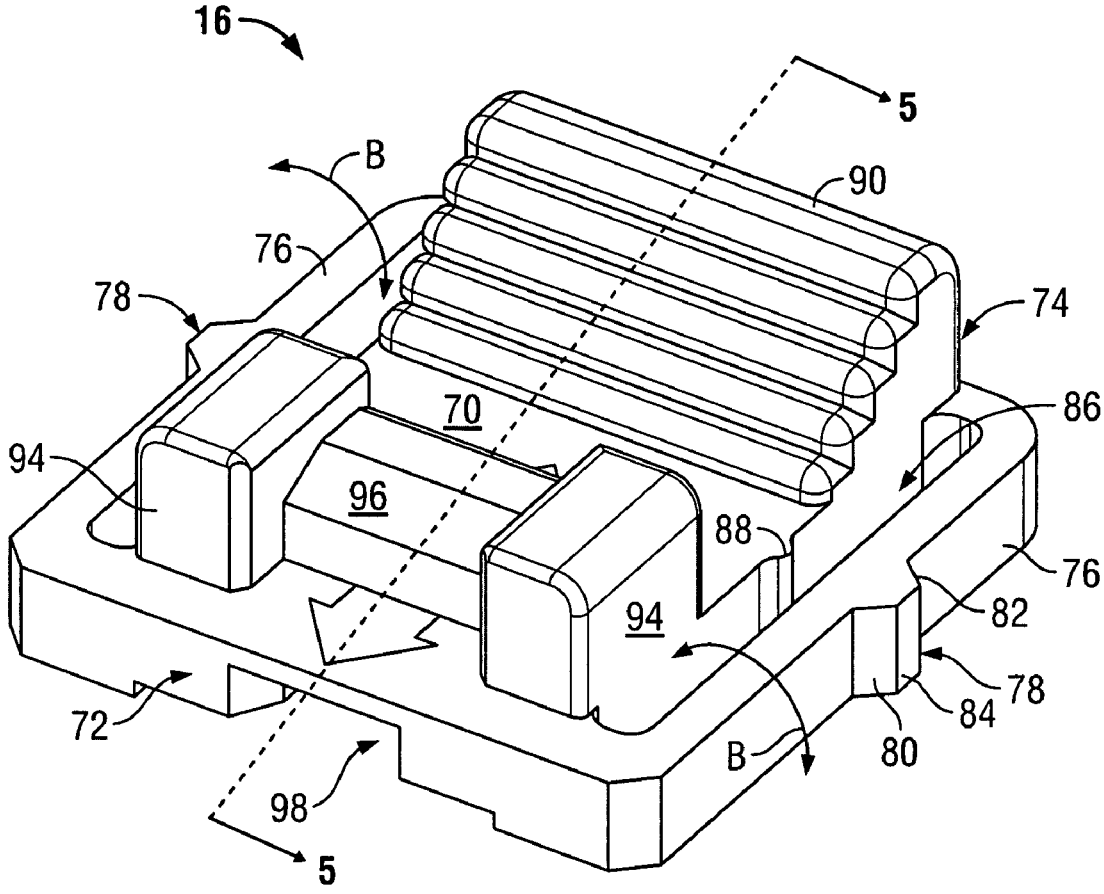
FIG. 4 is a perspective view of the CPA shown in FIG. 2.

FIG. 4 illustrates the CPA 16 in detail. The CPA 16 includes a platform portion 70 having a forward end 72 and a rearward end 74. The forward end 72 is oriented towards the housing body mating end 20 (see FIG. 1) when the cover 14 and the CPA 16 are mounted to the housing body 12 (see FIG. 1). Conversely the rearward end 74 is oriented to face in the direction of the wiring receiving end 18 (see FIG. 1) of the housing body 12 when the cover 14 and the CPA 16 are mounted on the housing body 12. A latch beam 76 is laterally spaced from each side of the platform 70. Each latch beam 76 extends from the forward end 72 to the rearward end 74.

As opposed to being cantilevered, the latch beams 76 are joined to the CPA platform portion 70 at both the forward end 72 and the rearward end 74. This simply supported design provides for greater latching force to be generated by the latch beams 76 without over stressing the latch beams 76 or requiring that they be fabricated from heavier and more expensive materials. Each latch beam 76 includes a latch element 78 that extends outwardly from the latch beam 76 and away from the platform 70. Each latch element 78 includes a forward facing ramp surface 80 and a rearward facing ramp surface 82 with a flat surface 84 therebetween. The ramp surfaces 80 and 82 allow the latch element 78 to encounter the step 64 in the cover CPA channel 30 (shown in FIG. 3) without binding. The CPA 16 includes a gap 86 between the latch beams 76 and the platform 70. When the CPA 16 is moved from a pre-staged position to a staged position, the latch elements 78 engage the steps 64 in the cover CPA channel 30 and deflect into the gap 86 prior to snapping over the step 64 as the CPA moves into the staged position. The CPA platform portion 70 includes a stop 88 aligned with latch elements 78 that operate to limit the amount of flexing of latch beams 76 as the CPA is moved back and forth between the pre-staged position and the staged position. The CPA platform 70 includes a raised serrated portion 90 at the rearward end 74 that is provided as a thumb grip for ease of operation of the CPA 16.

Stop blocks 94 are provided proximate the forward end 72 of the platform 70. The stop blocks 94 are configured to slide underneath the thumb pad 26 of the connector latch 22 on the housing body 12 (see FIG. 1) when the CPA 16 is moved to the staged position. Thus when moved to the staged position, depression of the thumb pad 26 is inhibited so that a mated connector cannot be separated from the housing body 12. A connecting member 96 is formed with the stop blocks 94 and adds rigidity to the stop blocks 94. The stop blocks 94 upwardly extend from the CPA platform 70. The platform 70 also includes an alignment slot 98 on an underside thereof that receives a guide bar on the housing body 12 (see FIG. 6) when the CPA is moved from the pre-staged position to the staged position.

Figure 5:
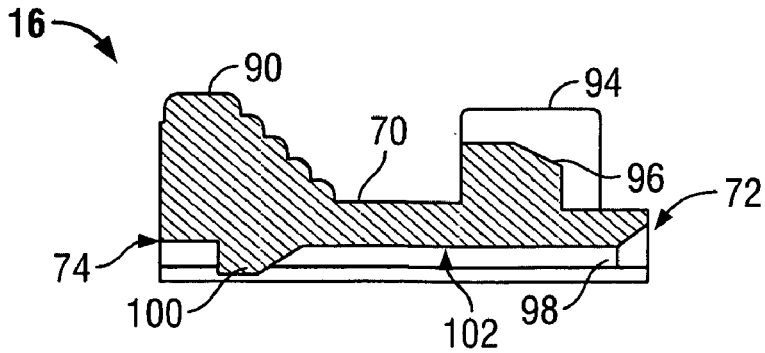
FIG. 5 is a cross sectional view of the CPA shown in FIG. 4 taken along the line 5—5 of FIG. 4.

FIG. 5 illustrates a cross sectional view of the CPA 16 taken along the section line 5—5 in FIG. 4. As shown in FIG. 5, the alignment slot 98 extends the length of the CPA 16 from the forward end 72 to the rearward end 74. A stop member 100 is formed on the underside 102 of the platform 70 and extends into the alignment slot 98 proximate the rearward end 74. The CPA stop 62 (see FIG. 3) in the CPA channel 30 of the cover 14 interferes with the stop member 100 to limit rearward movement of the CPA 16 in the channel 30. Generally, the stop member 100 is engaged by the CPA stop 62 when the CPA 16 is in the pre-staged position.

Figure 6:
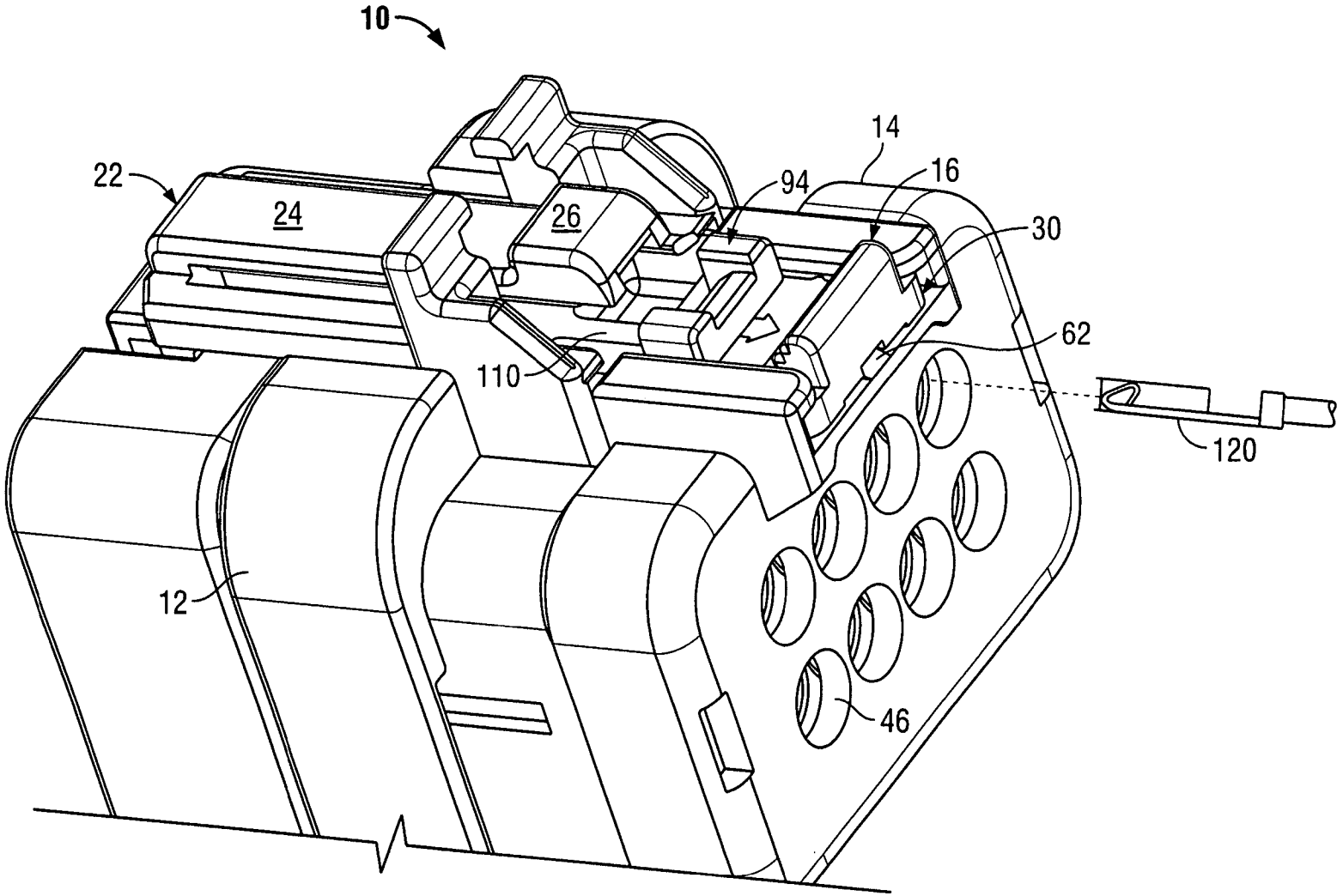
FIG. 6 is a perspective view of the cover and CPA of the connector shown in FIG. 1 mounted on the connector in a pre-staged condition.
Figure 7:
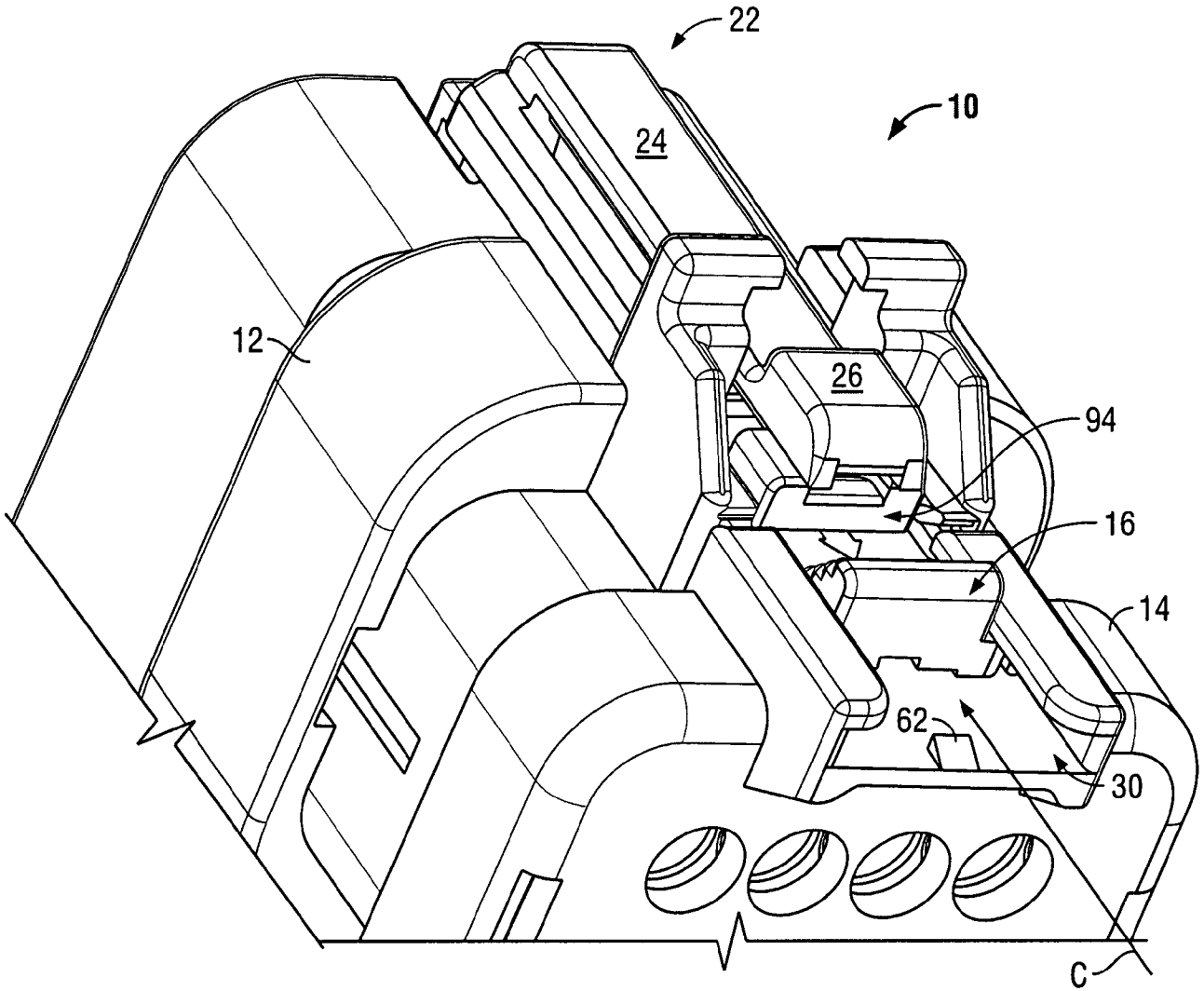
FIG. 7 is a perspective view of the cover and CPA of the connector shown in FIG. 1 mounted on the connector in a staged condition.

With reference to FIGS. 2, 6, and 7, the operation of the connector assembly 10 will be described. FIG. 2 illustrates the cover 14 and CPA 16 separated from the connector housing body 12. The CPA 16 is loaded into the channel 30 and moved to a pre-staged position wherein the CPA stop 62 (see FIGS. 3 and 7) is engaged with the stop member 100 on the underside 102 of the CPA 16. The cover 14 is then oriented with the housing body 12 so that a key (not shown) on the housing body 12 is aligned to be received in the key slot 54 on the cover 14. The cover is then advanced in the direction of the arrow A until the ridges 48 on the cover rear wall 38 abut and interfere with the wire receiving end 18 of the housing body 12. Force is continued to be applied in the direction of arrow A which causes the cover 14 to flex about the ridges 48 until the cover latch elements 34 snap into the latch recesses 50 on the cover side walls 40 (see FIG. 3) to lock the cover 14 onto the housing body 12 with a snap fit. Due to the interference action of the ridges 48 with the housing body 12, the cover 14 is sufficiently stabilized with respect to the housing body 12 that the CPA 16 can operate from the cover 14 to interact with the connector latch 22 on the housing body 12 that latches to hold a mating connector (not shown). The connector 10 is now in a pre-staged condition.

FIG. 6 illustrates a perspective view of the connector 10 in a pre-staged condition. In the pre-staged condition, the cover 14 is mounted on the housing body 12 with the CPA 16 in a rearward position against the CPA stop 62. A guide bar 110 on the housing body 12 is aligned to be received in the alignment slot 98 (see FIG. 4) of the CPA 16. The stop blocks 94 on the CPA 16 are positioned away from the thumb pad 26 of the connector latch 22 so that a mating connector can be joined with the connector 10. In the pre-staged condition, terminal contacts 120 may be loaded into the connector 10 through the contact receiving holes 46. The connector 10 may also be shipped in this condition.

FIG. 7 illustrates a perspective view of the connector 10 in a staged condition. After being joined to a mating connector (not shown), the connector 10 is placed in the staged condition by sliding the CPA 16 forward in the channel 30 toward the housing body mating end 20, in the direction of arrow C. The connector latch 22 on the housing body 12 engages the mating connector such that if the mating connector and the connector 10 are fully connected, the stop blocks 94 on the CPA 16 pass underneath the thumb pad 26 of the latch 22. The CPA 16 is now in a staged position wherein the latch elements 78 on the CPA latch beams 76 (see FIG. 4) are snapped over the steps 64 in the CPA channel 30 so that the CPA 16 is retained in the staged position. With the CPA 16 in the staged position, the thumb pad 26 on the connector latch 22 cannot be depressed so that the mating connector and the connector 10 remain joined with a reduced possibility of separation. Further, the simply supported latching arrangement wherein the latch beams 76 are joined at both ends to the CPA platform 70 provides a CPA 16 that facilitates the retention of the CPA 16 in the staged position.

The CPA 16 also gives an indication when the mating connector and the connector 10 are not fully joined. When the connectors are not fully joined, the connector latch 22 on the housing body 12 will not be properly seated on the mating connector. In this condition, the latch arm 24 will be raised from its neutral position, and in turn, the thumb pad 26 will be depressed from its neutral position. When it is attempted to slide the CPA 16 forward to the staged position, the thumb pad 26 will interfere with the stop blocks 94 preventing the CPA 16 from moving under the thumb pad 26 and into the staged position. Thus, the CPA 16 gives an indication that the mating of the connectors is not complete.

The embodiments thus described provide an electrical connector having a seal cover that, by the action of interfering ribs, is sufficiently stabilized to the connector housing to allow mounting of a CPA to the cover. The CPA uses a simply supported latch design that provides for a more robust latching action without the use of heavier, more expensive parts.

While the invention has been described in terms of various specific embodiments, those skilled in the art will recognize that the invention can be practiced with modification within the spirit and scope of the claims.

What is claimed is:

1. An electrical connector comprising:

a housing having a mating end and a wire receiving end, said wire receiving end configured to receive a terminal contact joined to a wire; and a cover provided on said wire receiving end of said housing, said cover including a ridge on an interior surface thereof to stabilize said cover on said housing; and a connector position assurance element (CPA) slidably received in a channel on said cover and movable between a pre-staged position and a staged position, said CPA engaging a connector latch on said housing to assure that a mating connector is fully mated to the connector when said CPA is in said staged position.

2. The connector of claim 1, wherein said ridge interferes with said wire receiving end of said housing to stabilize said cover on said housing.

3. The connector of claim 1, wherein said cover includes a side wall, said side wall having a recess on an interior surface thereof, said recess configured to receive a cover latch on said housing to secure said cover to said wire receiving end of said housing.

4. The connector of claim 1, wherein said cover flexes about said ridge when said cover is mounted on said housing.

5. The connector of claim 1, wherein said cover includes a keying slot to orient said cover relative to said housing.

6. The connector of claim 1, wherein said CPA includes a latch beam having a latch element thereon, said latch element engaging a step in said channel to latch said CPA to said cover.

7. The connector of claim 1, wherein said CPA includes a stop block that engages a connector latch on said housing to assure that a mated connector remains joined to the connector.

8. The connector of claim 1, wherein said cover includes a CPA stop positioned in said channel to engage a stop member on said CPA to retain said CPA in said channel.

9. The connector of claim 1, wherein said CPA includes a platform, and a latch beam, and a gap therebetween, said latch beam being deflected into said gap when said CPA is moved from said pre-staged position to said staged position.

10. An electrical connector comprising:

a housing having a mating end and a wire receiving end, said wire receiving end configured to receive a terminal contact joined to a wire;

a cover provided on said wire receiving end of said housing; and a connector position assurance element (CPA) slidably received in a channel on said cover, said CPA comprising:

a platform; and a latch beam having a first end oriented toward said mating end and a second end oriented toward said wire receiving end, said first and second ends both being joined to said platform, said latch beam configured to engage said channel to latch said CPA to said cover.

11. The connector of claim 10 wherein said CPA further includes a latch element positioned on said latch beam and configured to engage a step in said channel to latch said CPA to said cover.

12. The connector of claim 10, wherein said CPA includes a stop block that engages a connector latch on said housing to assure that a mated connector remains joined to the connector.

13. The connector of claim 10, wherein said cover includes a CPA stop positioned in said channel to engage a stop member on said CPA to retain said CPA in said channel.

14. The connector of claim 10, wherein said CPA further includes a gap between said platform and said latch beam, said latch beam being deflected into said gap when said CPA is moved from a pre-staged position to a staged position.

15. The connector of claim 10, wherein said cover includes a ridge on an interior surface thereof that interferes with said wire receiving end of said housing to stabilize said cover on said housing.

16. The connector of claim 10, wherein said cover flexes about a ridge on an interior surface of said cover when said cover is mounted on said housing.

17. An electrical connector comprising:

a housing having a mating end and a wire receiving end, said wire receiving end configured to receive a terminal contact joined to a wire; and a cover provided on said wire receiving end of said housing, said cover including a ridge on an interior surface thereof to stabilize said cover on said housing; and a connector position assurance element (CPA) slidably received in a channel on said cover and movable between a pre-staged position and a staged position, said CPA comprising an alignment slot that receives a guide bar on said housing to align said CPA with said housing.

18. The connector of claim 17, wherein said CPA further comprises:

a platform; and a latch beam having a first end oriented toward said mating end and a second end oriented toward said wire receiving end, said first and second ends both being joined to said platform, said latch beam configured to engage said channel to latch said CPA to said cover.

19. The connector of claim 17, wherein said cover flexes about said ridge when said cover is mounted on said housing.

20. The connector of claim 17, wherein said CPA includes a stop block that engages a connector latch on said housing to assure that a mated connector remains joined to the connector.

* * * * *